United States Patent [19]

Lahr

[11] Patent Number: 4,795,154

[45] Date of Patent: Jan. 3, 1989

[54] CONTINUOUS SLOT RACING SYSTEM

[75] Inventor: Robert G. Lahr, Las Vegas, Nev.

[73] Assignee: Ideal Loisirs, Le Blanc Mesnil, France

[21] Appl. No.: 66,114

[22] Filed: Jun. 25, 1987

[51] Int. Cl.[4] ..... A63F 9/14; A63H 18/08

[52] U.S. Cl. ..... 273/86 B; 446/446

[58] Field of Search ..... 273/86 B; 446/446; 238/10 F

[56] References Cited

U.S. PATENT DOCUMENTS

| | | | |
|---|---|---|---|
| 2,631,853 | 3/1953 | Haynes et al. | 273/86 B |
| 3,367,657 | 2/1968 | Cobbenhagen et al. | 273/86 B |
| 4,168,067 | 9/1979 | Wiczer | 248/221.4 X |
| 4,254,577 | 3/1981 | Cheng | 273/86 B X |

*Primary Examiner*—Anton O. Oechsle

*Attorney, Agent, or Firm*—Roger A. Marrs

[57] ABSTRACT

A toy vehicle game is disclosed herein permitting continuous toy car racing in an endless slotted track without interruption of competitive zeal between racing opponents. An endless track is employed having at least two parallel slotted lanes in which multiple toy vehicles may operate. Each slot on the curved sections of the track is provided with a shoulder narrowing the entrance leading into the slot. Each toy vehicle includes a guide beam travelling through the slot and pivotally carried on the underside of the vehicle wherein each guide beam includes a central portion terminating at the lower end in an expanded or enlarged guide slidably carried on the continuous slot beneath the shoulder while the upper end of the guide beam terminates in a rotational control element adapted to engage limit stops downwardly depending from the vehicle chassis to limit the pivotal or rotational turning of the vehicle about the guide beam due to centrifugal force. A snap lock arrangement releasably couples the guide beam to the underside of the toy vehicle.

7 Claims, 2 Drawing Sheets

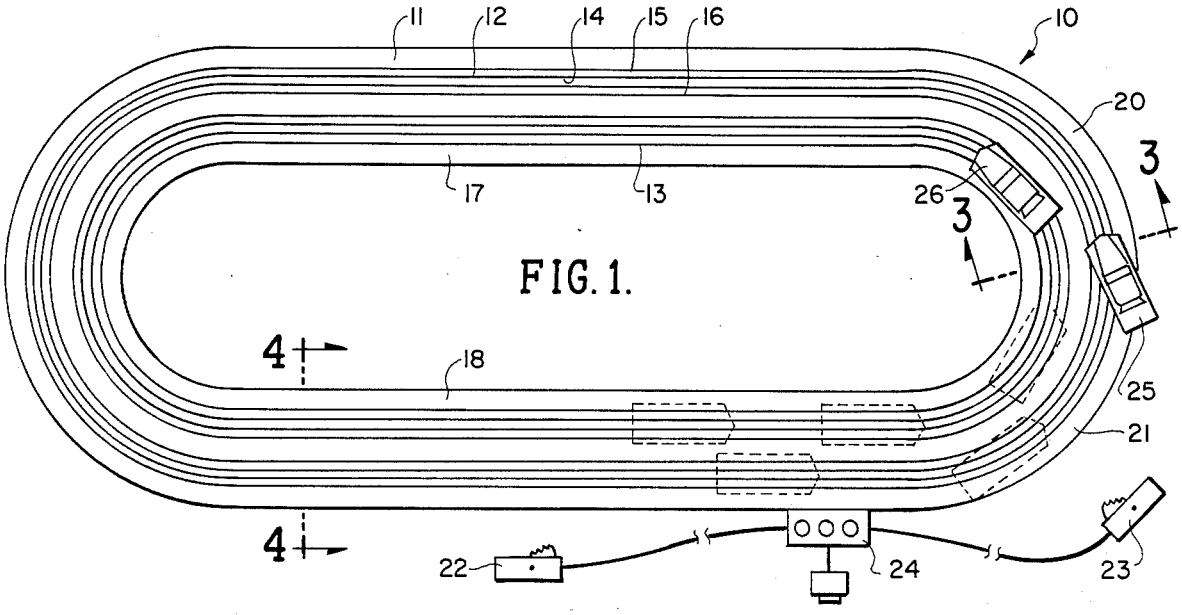
FIG. 1.
FIG. 3.
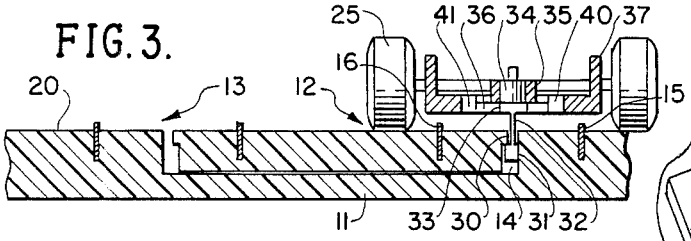
FIG. 4.
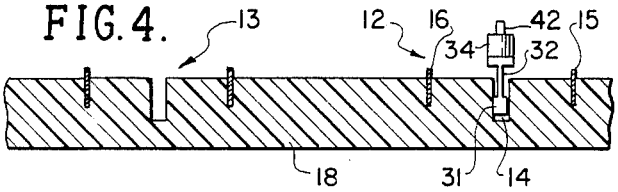
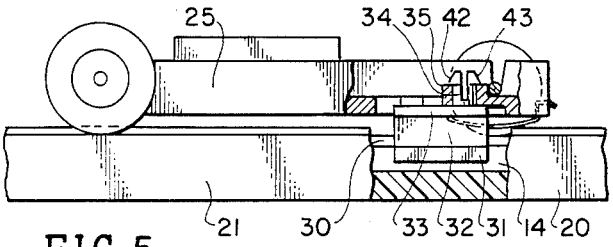
FIG. 5.
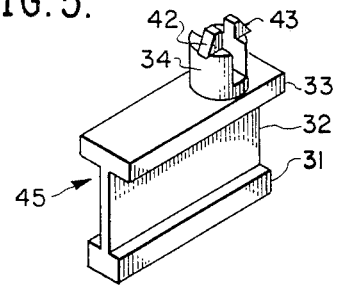
FIG. 6.
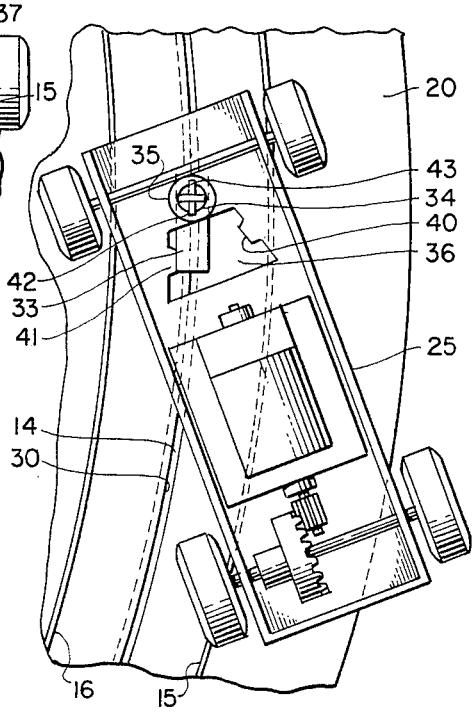
FIG. 2.
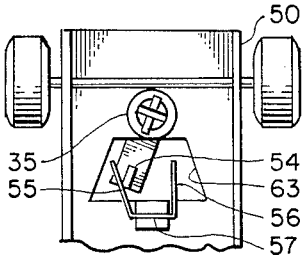
FIG. 10.

CONTINUOUS SLOT RACING SYSTEM

BACKGROUND OF THE INVENTION

1. Field of the Invention

The present invention relates to remotely controlled toy vehicles and more particularly to such a vehicle intended to be operated on an endless continuous track having means for not only holding the vehicle to the track but which limits rotational deployment of the vehicle at curves or turns so that opponents may enjoy continuous play or racing.

2. Brief Description of the Prior Art

In the past, it has been the conventional practice to place two or more vehicles in separate tracks on a game board wherein the vehicles are electrically motivated to travel at high speeds along the tracks in competition with one another. Generally, the tracks are endless and are arranged in a curvilinear manner so that the vehicles may be in competition over a simple oval track or a more torturous track such as a FIG. 8 or other geometrical convolutions In any event, centrifugal forces are generated at the curves which generally cause the toy vehicle to spin-out or, in most events, to actually leave the track and fly off of the game board. Such undesirable action is attributed to the fact that the toy vehicles are not secured or fixed to the track over which they travel since the only contact the car has with the track is through a downwardly depending guide rod that merely travels through the slot as the car is powered over the track To counteract the undesired leaving of the toy car from the track at curves, magnets have been placed at the rear of the car having an attractive force or relationship with the power conductors commonly disposed along either a side of the slot on the track. Although such magnetic of either permanent or electromagnetic type is useful in controlling fly-off of the car from the track, the centrifugal force sometimes even exceeds the magnetic attraction and the car or vehicle still leaves the track.

In other instances, the downwardly depending guide rod from the vehicle which travels through the slot sometimes permits excessive rotation or spin of the vehicle at the curves so that the rear of the vehicle outwardly extends beyond the limits of the track so that the wheels are not engageable in driving relationship with the track. In such instances, the game is stopped and the vehicles must be reset onto the track. In order to eliminate this problem, some tracks include extra sections on the playing board which constitute extensions adapted to permit the rear driving wheels of U-turn vehicles sufficient traction for regaining advancement.

The effects of the above problems reside in discontinuance of a game which necessitates restarting and replaying. However, the same problems exist and the toy vehicle may either spin-out or leave the track causing an additional restart and delay in the over-all play of the game. This outcome is disadvantageous since it results in eventual disinterest in the competitors to continue playing the game.

Therefore, a long standing need has existed to provide a means for capturing or retaining the movable toy vehicle on the track and which takes into account centrifugal forces at curves so that the vehicle will not only retain on the track but will be in a position to regain speed after momentarily stopping. Also, it is desirable to provide stop or limit means so that spin-out of the vehicle can be avoided.

SUMMARY OF THE INVENTION

Accordingly, the above problems and difficulties are obviated by the present invention which provides a novel means for providing continuous slot car racing which includes an endless track having a slot defined with a restricted entrance leading into the slot and which incorporates a downwardly depending guide means on the toy vehicle so that the guide means is slidably engaged in the restricted slot. The restrictive coupling between the slot and the guide means prevents detachment of the car from the track, particularly on curved sections, and limit means are further provided on the underside of the car which cooperate with the guide means and the car to limit rotation of the vehicle on the guide means between limit stops providing a restricted range of pivotal movement. Furthermore, the guide means is releasably attached to the underside of the vehicle permitting decoupling, when desired, to remove the vehicle from the track.

Therefore, it is among the primary objects of the present invention to provide a novel game including powered toy vehicles permitting continuous operation of the vehicles in competition with one another so that the game may be played from beginning to end without undesired detachment of the cars from the playing track.

Another object of the present invention is to provide a novel means for detachably connecting a toy powered vehicle to a guide means slidably operated in a slot whereby centrifugal forces or loads encountered at curves will not disconnect or permit the undesired fly-off of the vehicle from the track.

Another object of the present invention is to provide a novel toy powered racing car system wherein the cars are permitted limited rotation at curves and which include restrictive means for preventing the leaving of the car from the track due to centrifugal force.

Still a further object of the present invention is to provide a novel continuous slot car racing system wherein the cars will stay on the track in competitive relationship for continuous operation by the competitors and which includes means for limiting rotation of the vehicles with respect to the slot and track as well as means for preventing inadvertent detachment or decoupling of the car from the track during the course of play.

Another object resides in providing a slot car racing system employing race and chase techniques utilizing a U-turn car making a 180° turnaround.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a top plan view of a typical racing track layout, illustrating continuous tracks and toy powered vehicles thereon;

FIG. 2 is an enlarged plan view of a powered toy car on a curved portion of the track shown in FIG. 1;

FIG. 3 is a transverse cross-sectional view of the curved portion of the track shown in FIG. 1 and taken in the direction of arrows 3—3 thereof;

FIG. 4 is a transverse cross-sectional view of a linear section of track used in FIG. 1 as taken in the direction of arrows 4—4 thereof;

FIG. 5 is a side elevational view of the powered vehicle and track with a portion broken away to illustrate the guide means thereof;

FIG. 6 is a perspective view of the guide means used to slidably connect the powered toy vehicle and the track in sliding relationship;

FIG. 10 is a fragmentary plan view of the vehicle of the second embodiment illustrating another stop means for limiting rotational movement of the vehicle with respect to the track.

DESCRIPTION OF THE PREFERRED EMBODIMENT

Figure 7:
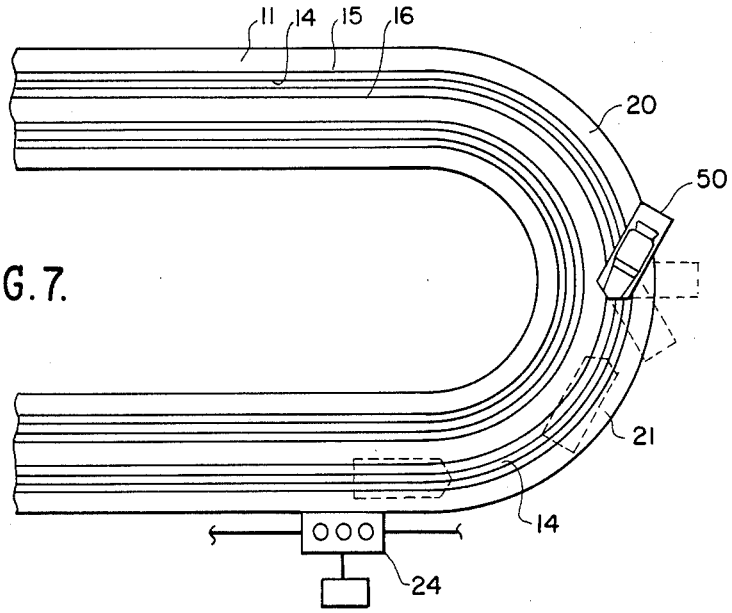
FIG. 7 is a plan view of a curved portion of an endless track showing a different version of coupling means for slidably retaining the powered toy vehicle on the track.

Referring to FIG. 1, an endless track for accommodating a plurality of powered toy vehicles is illustrated in the general direction of arrow 10 which includes an oval-shaped base member 11, having a pair of lanes 12 and 13 along which the powered toy vehicles are intended to travel The lanes include a continuous slot, such as slot 14 associated with lane 12, and the slot separates a pair of metallic conductors 15 and 16 which supply electrical energy to power the motor in the respective toy vehicles. These lanes are established by the slot and pair of power conductors and it is to be understood that at least two such lanes or tracks are required for competition between opponents having different cars on the same track or base member. Also, it is to be understood that battery-operated cars may be employed incorporating the inventive concept or self-powered cars such as wind-up, coil spring, or other motive means may be employed FIG. 1 further illustrates that the base member 11 is composed of a plurality of track segments which are joined together to provide a continuous and an endless track. The linear or straight tracks are indicated respectively by numerals 17 and 18 while curved or arcuate members of track are identified by numerals 20 and 21 associated with one end of the endless track.

As is conventionally used, a pair of hand-held controllers 22 and 23 are illustrated and are electrically connected through a transformer and control box 24 to the metallic conductors 15 and 16 associated with each of the continuous tracks. In this fashion, electricity is provided through shoes carried on the underside of each of the vehicles for introducing electrical power to the motors in the cars. Car 25 is associated with the outside track or lane 12 while car 26 is associated with the inner track or lane 13. Car 26 is illustrated as having negotiated the curve composed of arcuate or curved track members 20 and 21. The speed at which the car or vehicle 26 travels is such that centrifugal forces or loads have not built to an extent that the car would normally tend to leave the track. On the other hand, car 25 is illustrated as travelling at a higher rate of speed so that the rear end of the car is thrown counterclockwise and, under conventional circumstances, would leave the track.

Referring now in detail to FIG. 3, it can be seen that the vehicle 25 is held in position on the track 20 by means of a guide means which interconnects the vehicle 25 with the base member 11. The slot 14 is provided with a reduced or restricted top leading into the interior of the slot by a flange or shoulder 30 which captures an enlargement 31 carried on the bottom of the central portion 32 of the guide means. The top of the central portion 32 is provided with an enlargement 33 which includes a cylindrical pivot 34 arranged in a snap-lock relationship with a receptacle 35 carried on the chassis of the toy vehicle. The snap-lock arrangement will be described later. However, it is also to be noted in FIG. 3 that the upper enlargement of the guide means identified by numeral 30 resides within a cavity 36 of the chassis 37. The opposite sides of the cavity include a pair of stop members 40 and 41, more clearly shown in FIG. 2, which are arranged in spaced apart relationship on either side of the upper enlarged portion 33 of the guide member. Therefore, rotation of the vehicle is limited by engagement of the sides of the enlargement 33 with either of the stop members 40 or 41.

FIG. 3 further illustrates that the car 25 is slidably retained on the base member 11 by means of the guide means having its lower enlargement 31 captured in the slot 14 under the flange or shoulder 30. Since the thickness of the enlargement 31 is greater than the entrance leading into the slot, the car is captured and cannot leave the track.

Referring to FIG. 4, the linear or straight length of track is illustrated wherein the shoulder 30 used on the curved track 20 is not necessary. Therefore, the enlargement 31 of the guide means merely projects into the depths of the track in sliding engagement with the opposite surfaces defining the track 14. The upper end of the guide means includes the pivot 34 with a pair of resilient toothed projections, such as projection 42, that are arranged to snap-lock over the top of the receptacle 35 carried on the chassis of the car. In FIG. 5, the projections 42 and 43 are illustrated. The projections are carried on the top of pivot 34 that may be described as being bifurcated so as to permit a certain amount of flexibility for the projections 42 and 43 to be snapped in and out of the receptacle 35 in snap-lock relationship. The projections snap across the top of the receptacle 35. Therefore, should the car 25 come to a stop anywhere on the track, the operator can physically move the car along to a desired position or the expanding resistance of the projections can be overcome and the car can be pulled upwardly out of engagement and separated from the guide means. The guide means can then be moved along the slot to a desired location such as on the straightaway, followed by reinsertion of the projections into the receptacle and snap-lock adjoining. The projections are tapered on their upper and lower side surfaces to permit ease of insertion or withdrawal of the guide member from car chassis.

In FIG. 5, the snap-lock relationship of the projections with the receptacle is more clearly illustrated, as well as the fact that the enlarged portion 31 of the guide means is captured beneath the shoulder 30.

FIG. 6 illustrates the guide means in the general direction of arrow 45, and it can be seen that the guide means is an integral molded part having a cross-section substantially in the shape of an "I" beam.

Therefore, should the vehicle 25 be advanced at extreme speeds by the operator, the car entering the curved section of track will encounter centrifugal load conditions that will cause the rear of the vehicle to progress outwardly. As such, the car will pivot about the pivot 34 until one of the opposite sides of the enlargement 33 on the guide means 45 encounters a stop. As shown in FIG. 2, the side of the enlargement is engaged with stop 41 so that further rotation is prevented. At such a speed, an immediate braking action is produced because of the binding or frictional contact of the guide means central section 32 with the opposite sides of the slot entrance 14. The car will immediately stop. At this time, the car just starts up at throttle setting or, in some instances, the car can be reoriented so that continued play is available. Therefore, there is no need to restart the race. A feature resides in providing the shoulders 30 for the pair of slots by molding a central track member which may be glued inside the cavity of the base member or otherwise fastened, such as heat sealed, snap-lock riveted, etc., so that the pair of tracks are well defined in separated and spaced apart relationship. FIG. 3 shows such a construction.

Figure 8:
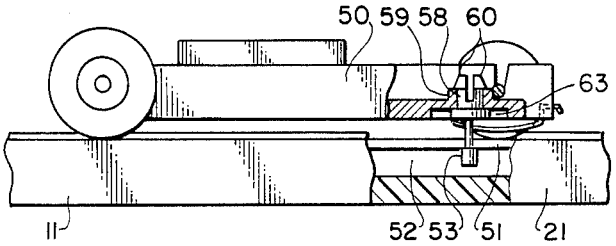
FIG. 8 is a side elevational view, partly broken away, of the second version or embodiment of the invention and illustrating the coupling for slidably engaging the powered toy vehicle with the track.
Figure 9:
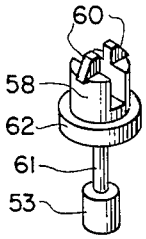
FIGS. 9 and 9*a* are views showing the second embodiment of the guide means as used in the coupling relationship of FIG. 8.
Figure 9A:
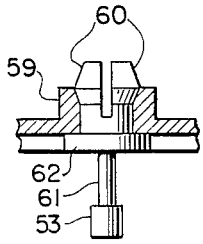

Referring now in detail to FIGS. 7 and 8, another embodiment of the invention is shown wherein a car 50 is permitted to rotate at 180° on attaining excessive speed. Again, a shoulder is provided on the track as shown in FIG. 8 by numeral 51 and the track slot is illustrated by numeral 52. An enlargement of the guide means is illustrated by numeral 53 which engages with the underside of the flange or shoulder 52 for retainment in sliding relationship therewith. As previously discussed, the guide means is snap-locked to the chassis by means of the pivot 58, rotatably carried within a receptacle 59 via the pair of snap-lock members identified by numeral 60. This relationship is shown in FIGS. 8 and 9. The guide means is more clearly shown in the perspective view of FIG. 9 wherein a central rod portion 61 connects the enlargement 53 with the upper enlargement 62. The upper enlargement resides within the cavity 63 of the vehicle chassis.

Although the pivot post 35 on the guide means of FIG. 6 is located off-center between the opposite ends of the central portion 32, it is to be understood that the pivot post may be located midway between the opposite ends whereby the car may rotate about the post for several revolutions. Thus, central or mid location of the pivot post on the guide means may be used in combination with another type car for competitive racing in another manner.

However, another stop means is shown in FIG. 10 whereby the wide angle of pivot or rotation by the car 50 is attained by providing the guide member or means with a downwardly depending projection 54 that engages with either one leg 55 or the other leg 56 of the U-shaped spring member 57. The legs are resilient so that encounter with projection 54 provides a slight extension of the springs and build-up of energy which is released to urge the car back into its forward-facing and forward-running position.

Therefore, it can be seen that in both versions of cars, the toy powered vehicle is captured on the track by sliding engagement of the guide means with the shoulder of the track. Also, rotational movement is limited in one car version by means of engagement of the downwardly projecting element carried on the chassis of the vehicle with either the stops on the opposite sides of the cavity or by engagement of the projection with the legs of the spring. The car version using the central pivot can rotate 360°. Rotational movement of 180° turnaround, for example, is governed by the skill of the operator. For this latter version, a diode system within the car provides for the motor to always run in the same direction regardless of orientation of the current collecting shoes carried on the car relative to the conductive rails. In either case, the powered toy vehicle is held to the track curves and may be easily oriented into its original forward-running condition by the vehicle starting up on its own.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In a continuous slot car racing system having a slotted track including curved sections of track about which a toy vehicle traverses, the improvement which comprises:

said slot of each track curved section having an entrance leading into said slot defined by opposing parallel apart wall surfaces of said curved section;

said slot entrance narrowed by a shoulder projecting into said slot entrance wherein said shoulder includes an undersurface communicating with said slot immediately below said slot entrance;

guide means downwardly depending from said toy vehicle slidably disposed within said slot and being of greater mass than the spacing between opposing wall surfaces of said slot beneath said shoulder;

said shoulder cooperating with said guide means to slidably maintain and retain said toy vehicle on said track curved sections;

said guide means includes a pivot post and said toy vehicle includes a receptacle for insertably receiving and coupling with said pivot post;

said guide means comprises a body having an enlarged portion carried on its underside with said pivot post carried on its topside;

said enlarged portion substantially occupying the width of said slot beneath said slot entrance and said shoulder;

a rotational control means carried on the underside of said toy vehicle cooperating with said guide means to restrict rotation of said toy vehicle within a predetermined range; and said rotational control means includes at least one limit means and said guide means includes an upright projection disposed to cooperate with said limit stop means and adapted to engage in response to rotation of said toy vehicle.

2. The invention as defined in claim 1 including:

snap-lock means detachably coupling said guide means to said toy vehicle.

3. The invention as defined in claim 1 wherein:

said snap-lock means includes a pair of bifurcated tapered projections carried on said guide means releasably engagable with a receptacle carried on said toy vehicle.

4. The invention as defined in claim 1 including:

pivot means releasably coupling said guide means to said toy vehicle including tapered projections carried on said guide means disposed in snap-lock relationship with respect to said toy vehicle.

5. In a continuous slot car racing system having a slotted track including curved sections of track about which a toy vehicle traverses, the improvement which comprises:

said slot of each track curved section having an entrance leading into said slot defined by opposing parallel apart wall surfaces of said curved section;

said slot entrance narrowed by a shoulder projecting into said slot entrance wherein said shoulder includes an undersurface communicating with said slot immediately below said slot entrance;

guide means downwardly depending from said toy vehicle slidably disposed within said slot and being of greater mass than the spacing between opposing wall surfaces of said slot beneath said shoulder;

said shoulder cooperating with said guide means to slidably maintain and retain said toy vehicle on said track curved sections;

said guide means includes a pivot post and said toy vehicle includes a receptacle for insertably receiving and coupling with said pivot post;

said guide means comprises a body having an enlarged portion carried on its underside with said pivot post carried on its topside;

said enlarged portion substantially occupying the width of said slot beneath said slot entrance and said shoulder;

a rotational control means carried on the underside of said toy vehicle cooperating with said guide means to restrict rotation of said toy vehicle within a predetermined range;

said rotational control means includes a limit stop having a substantially U-shaped spring wire having a pair of resilient legs cantilevered outwardly from opposite ends of a cross bar in spaced relationship; and said guide means having an upright projection disposed between said pair of resilient legs and adapted to engage one leg or the other in response to rotation of said toy vehicle.

6. In a continuous slot car racing system having a slotted track including curved sections of track about which a toy vehicle traverses, the improvement which comprises:

said slot of each track curved section having an entrance leading into said slot defined by opposing parallel apart wall surfaces of said curved section;

said slot entrance narrowed by a shoulder projecting into said slot entrance wherein said shoulder includes an undersurface communicating with said slot immediately below said slot entrance;

guide means downwardly depending from said toy vehicle slidably disposed within said slot and being of greater mass than the spacing between opposing wall surfaces of said slot beneath said shoulder;

said shoulder cooperating with said guide means to slidably maintain and retain said toy vehicle on said track curved sections;

said guide means includes a pivot post and said toy vehicle includes a receptacle for insertably receiving and coupling with said pivot post;

said guide means comprises a body having an enlarge portion carried on its underside with said pivot post carried on its topside;

said enlarged portion substantially occupying the width of said slot beneath said slot entrance and said shoulder;

a rotational control means carried on the underside of said toy vehicle cooperating with said guide means to restrict rotation of said toy vehicle within a predetermined range;

said rotational control means includes resilient means carried on said vehicle; and said guide means includes an upright projection cooperating with said resilient means to limit rotational movement of said vehicle with respect to said guide means.

7. In a continuous slot car racing system having a slotted track including curved sections of track about which a toy vehicle traverses, the improvement which comprises:

said slot of each track curved section having an entrance leading into said slot defined by opposing parallel apart wall surfaces of said curved section;

said slot entrance narrowed by a shoulder projecting into said slot entrance wherein said shoulder includes an undersurface communicating with said slot immediately below said slot entrance;

guide means downwardly depending from said toy vehicle slidably disposed within said slot and being of greater mass than the spacing between opposing wall surfaces of said slot beneath said shoulder;

said shoulder cooperating with said guide means to slidably maintain and retain said toy vehicle on said track curved sections;

said guide means includes a pivot post and said toy vehicle includes a receptacle for insertably receiving and coupling with said pivot post;

said guide means comprises a body having an enlarged portion carried on its underside with said pivot post carried on its topside;

said enlarged portion substantially occupying the width of said slot beneath said slot entrance and said shoulder;

a rotational control means carried on the underside of said toy vehicle cooperating with said guide means to restrict rotation of said toy vehicle within a predetermined range; and said rotational control means includes a pair of limit stops disposed in fixed spaced-apart relationship and said guide means includes an upright projection disposed between said pair of limit stops and adapted to engage one stop or the other in response to rotation of said toy vehicle.

* * * * *